US007084569B2

(12) United States Patent
Tachibana et al.

(10) Patent No.: US 7,084,569 B2
(45) Date of Patent: Aug. 1, 2006

(54) PLASMA DISPLAY PANEL

(75) Inventors: Hiroyuki Tachibana, Osaka (JP); Naoki Kosugi, Kyoto (JP); Masafumi Okawa, Osaka (JP); Ryuichi Murai, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/512,580

(22) PCT Filed: Feb. 18, 2004

(86) PCT No.: PCT/JP2004/001811

§ 371 (c)(1),
(2), (4) Date: Oct. 26, 2004

(87) PCT Pub. No.: WO2004/075238

PCT Pub. Date: Sep. 2, 2004

(65) Prior Publication Data

US 2005/0151476 A1 Jul. 14, 2005

(30) Foreign Application Priority Data

Feb. 20, 2003 (JP) ..... 2003-042868
Nov. 13, 2003 (JP) ..... 2003-383551

(51) Int. Cl.
*H01J 17/49* (2006.01)

(52) U.S. Cl. ..... 313/583; 313/584

(58) Field of Classification Search ..... 313/583, 313/584
See application file for complete search history.

(56) References Cited

U.S. PATENT DOCUMENTS

| | | | | |
|---|---|---|---|---|
| 5,754,004 | A * | 5/1998 | Miyagawa et al. | 313/585 |
| 6,346,772 | B1 * | 2/2002 | Nishiki et al. | 313/587 |
| 6,621,217 | B1 * | 9/2003 | Nishiki et al. | 313/587 |
| 6,787,992 | B1 * | 9/2004 | Chuman et al. | 313/505 |
| 2002/0024498 | A1 * | 2/2002 | Vos et al. | 345/156 |
| 2002/0074941 | A1 * | 6/2002 | Fujiwara | 313/584 |
| 2003/0209983 | A1 * | 11/2003 | Harada | 313/586 |
| 2005/0040766 | A1 * | 2/2005 | Tachibana et al. | 313/586 |
| 2005/0067957 | A1 * | 3/2005 | Moon | 313/582 |

FOREIGN PATENT DOCUMENTS

| | | |
|---|---|---|
| JP | 5-2992 | 1/1993 |
| JP | 5-250994 | 9/1993 |
| JP | 6-236734 | 8/1994 |
| JP | 8-96714 | 4/1996 |
| JP | 9-259768 | 10/1997 |
| JP | 2001-210243 | 8/2001 |
| JP | 2002-50300 | 2/2002 |

* cited by examiner

*Primary Examiner*—Joseph Williams
*Assistant Examiner*—Peter Macchiarolo
(74) *Attorney, Agent, or Firm*—Wenderoth, Lind & Ponack, L.L.P.

(57) ABSTRACT

A highly reliable plasma display panel is provided with less difference in wiring resistance, which can be driven at high speed even though the front or rear board has multilayer electrode wiring. A data electrode is covered with a dielectric layer, and a priming electrode is provided on the dielectric layer. An external wiring lead-out of the data electrode is provided on a rear substrate, and an external wiring lead-out of the priming electrode is provided on the dielectric layer. Wiring lead-out of the data electrode and wiring lead-out of the priming electrode have a step equivalent to the thickness of the dielectric layer.

7 Claims, 13 Drawing Sheets

PLASMA DISPLAY PANEL

TECHNICAL FIELD

The present invention relates to plasma display panels, and more particularly to plasma display panels achieving highly reliable connections in multilayer electrode wiring.

BACKGROUND ART

Plasma display devices employing plasma display panels (PDPs) are drawing increasing attention as display devices for high-definition television images on large screens.

A PDP is basically composed of front and rear boards. The front board includes a glass substrate, display electrodes including transport electrodes and bus electrodes aligned in stripes on one main face of the glass substrate, a dielectric layer covering the display electrodes that functions as a capacitor, and a dielectric protective film formed on the dielectric layer. The rear board includes a glass substrate, address electrodes aligned in stripes on one main face, a dielectric layer covering the address electrodes, barrier ribs formed on the dielectric layer, and a phosphor layer which emits red, green, and blue lights formed between barrier ribs.

The electrodes on the front and rear boards face each other, and their peripheries are hermetically sealed. Discharge gas such as neon (Ne)—xenon (Xe) is injected into the discharge space created by the barrier ribs at pressures of 400~600 torr. The discharge gas is discharged by selectively applying video signal voltages to the display electrodes. Ultraviolet rays emitted by the discharge gas excite the different color phosphor layers. Red, green, and blue light is thus emitted to display color images.

A wiring lead-out of display electrodes on the front board and address electrodes on the rear board are provided on respective boards in the same plane, and a flexible printed circuit board (FPC) is press-bonded on the lead-out via an anisotropic conductive member to connect to external wiring. One example of a PDP in which these electrodes have a multilayer structure on each board by interposing an insulating layer with a predetermined thickness is disclosed in Japanese Laid-open Patent No. 2001-210243. In this example, the electrode wiring layer on the front board has scanning electrodes and sustainS electrodes as the first electrode layer, and trigger electrodes separated by the dielectric layer as the second electrode layer.

In this method of press-bonding the FPC onto the wiring lead-out via the anisotropic conductive member for coupling the wiring lead-out to the external wiring, the wiring lead-out is provided on the four sides which are the periphery of the PDP, and the electrodes are disposed in such a way that the potential applied to the wiring lead-out on each side is uniform. Accordingly, the wiring lead-out on each side is provided in the same plane to avoid coupling failure between the wiring lead-out and the FPC while press-bonding the FPC onto each side. If electrodes are given a multilayer structure by interposing the insulating layer, in addition to providing wiring lead-outs in such a way that the potential applied to each side is uniform, the electrode wiring in the second layer is disposed in such a way as to cross a step of the insulating layer at the wiring lead-out. This makes the thickness of electrode wiring on the second layer thinner at the step, resulting in increasing the wiring resistance or causing disconnection.

The present invention aims to offer a highly reliable PDP by stabilizing the characteristics of the electrode wiring at the wiring lead-out even if the electrodes formed on the boards have a multilayer structure and their applied potential differs.

SUMMARY OF THE INVENTION

A PDP of the present invention includes a front board having a first electrode that at least acts as a display electrode, and a rear board having a second electrode which at least acts as a data electrode and creates a discharge space with the front board. The periphery of the front board and rear board is sealed to configure the PDP. A third electrode is disposed on the first electrode or second electrode with the dielectric layer in between. A lead-out of the first or second electrode to external wiring and a lead-out of the third electrode to external wiring are provided with a step equivalent to the thickness of the dielectric layer.

The above configuration allows the formation of each electrode in the same plane up to the wiring lead-out. This results in stable electrode wiring characteristics at the wiring lead-out, making feasible a highly reliable PDP.

DETAILED DESCRIPTION OF PREFERRED EMBODIMENT(S)

Preferred embodiments of the present invention are described below with reference to drawings.

FIRST EXEMPLARY EMBODIMENT

Figure 1:
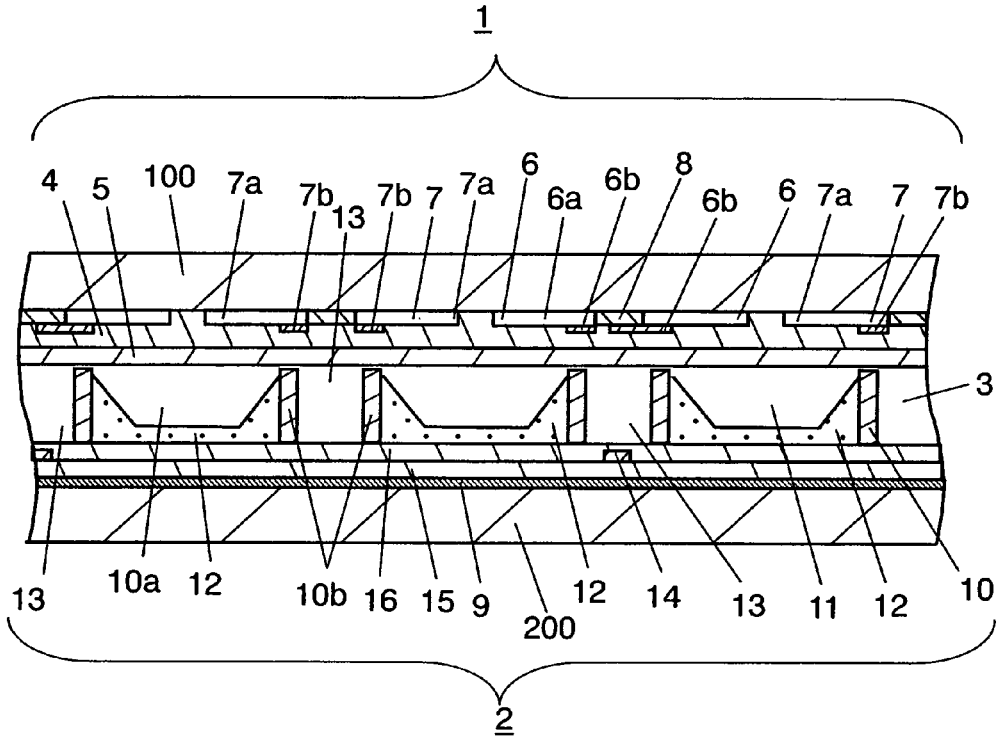
FIG. 1 is a sectional view of a PDP in accordance with the first exemplary embodiment of the present invention.
Figure 2:
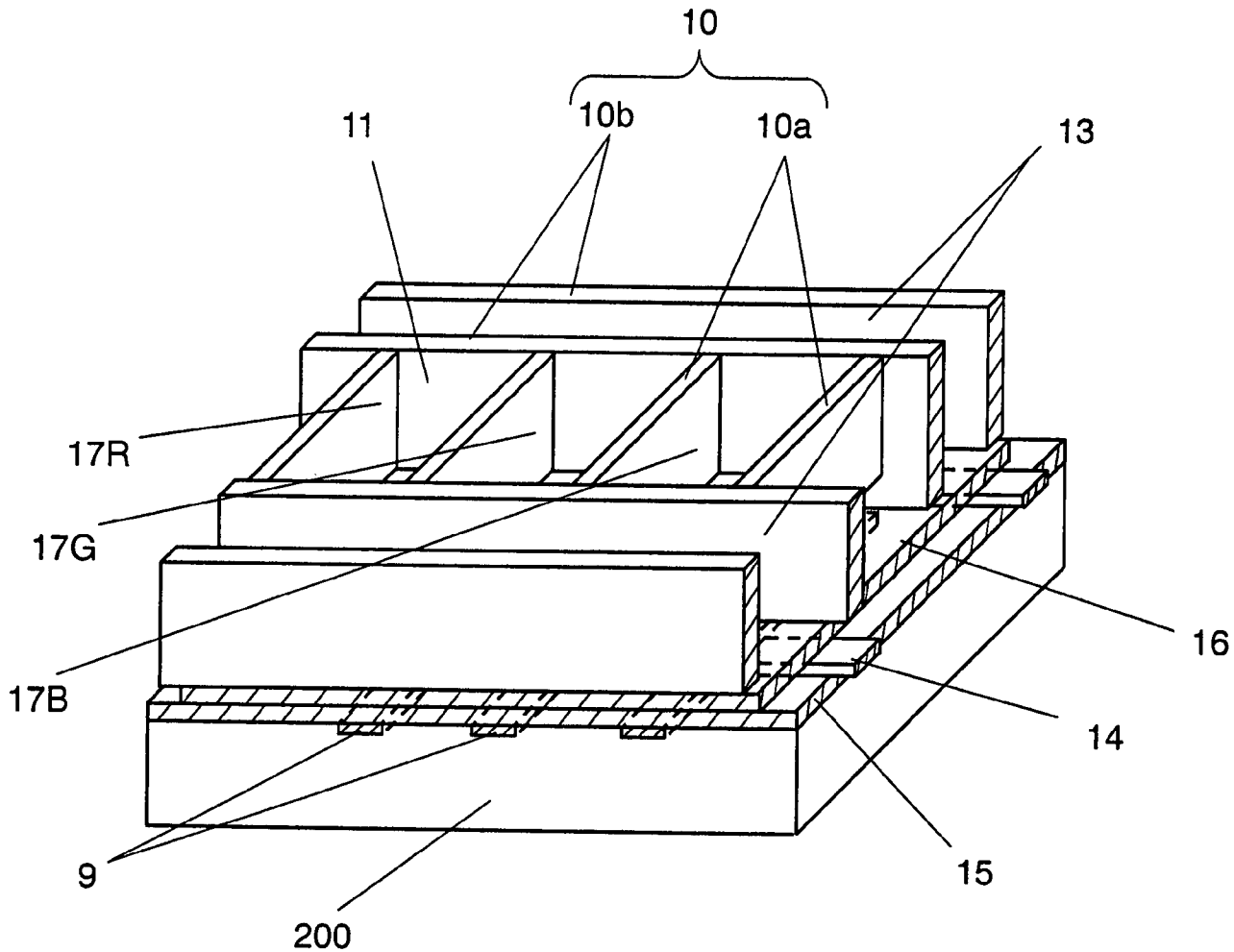
FIG. 2 is a perspective view of a rear board of the PDP in accordance with the first exemplary embodiment of the present invention.

FIG. 1 shows a sectional view of a PDP in the first exemplary embodiment of the present invention. FIG. 2 is a perspective view of a rear board of the PDP in the first exemplary embodiment of the present invention.

As shown in FIG. 1, front board 1 and rear board 2 face each other with discharge space 3 in between. Gases such as neon (Ne) and xenon (Xe) are injected into this discharge space 3 and emit ultraviolet rays when subjected to electric discharge. The first electrode, which acts as a display electrode, includes stripes of a pair of scanning electrodes 6 and sustain electrodes 7 aligned in parallel and covered with dielectric layer 4 and protective film 5, and is disposed on front substrate 100. These scanning electrodes 6 and sustain electrodes 7 are configured, respectively, with transparent electrodes 6*a* and 7*a*, and metal bus lines 6*b* and 7*b*, made such as of silver (Ag) for better conductivity. Metal bus lines 6*b* and 7*b* are overlaid on transparent electrodes 6*a* and 7*a*. Moreover, scanning electrodes 6 and sustain electrodes 7 are alternately aligned in two rows each such as scanning electrode 6—scanning electrode 6—sustain electrode 7—sustain electrode 7, and so on. Optical absorption film 8 made of black material is provided between rows of scanning electrodes 6 and between rows of sustain electrodes 7.

As shown in FIGS. 1 and 2, stripes of data electrodes are disposed in parallel to each other on rear substrate 200 of rear board 2 as the second electrode in a direction perpendicular to scanning electrodes 6 and sustain electrodes 7. Moreover, barrier ribs 10 for diving discharge cells formed with scanning electrodes 6, sustain electrodes 7, and data electrodes 9 are formed on rear board 2. Phosphor layer 12 corresponding to each discharge cell is formed on cell space 11 divided by barrier ribs 10. Barrier ribs 10 create cell space 11 with vertical wall 10*a* stretching so as to intersect at right angles with scanning electrodes 6 and sustain electrodes 7 on front board 1, i.e., parallel to data electrode 9; and horizontal wall 10*b* crossing this vertical wall 10*a*. Horizontal wall 10*b* also creates gap 13 between cell spaces 11. Optical absorption film 8 formed on front board 1 is disposed at positions corresponding to space in gap 13 formed between horizontal walls 10*b* of barrier rib 10.

In gap 13 of rear board 2, priming electrode 14, the third electrode, for triggering a discharge in the space of this gap 13 between front board 1 and rear board 2 is formed intersecting at right angles with data electrode 9. A priming cell is thus formed in gap 13. This priming electrode 14 is formed on dielectric layer 15 covering data electrode 9, and dielectric layer 16 is further formed to cover priming electrode 14. Accordingly, priming electrode 14 is formed in a position closer to the space of gap 13 than data electrode 9. In addition, priming electrode 14 is formed only at the position of gap 13 opposing adjacent scanning electrodes 6 to which a scanning pulse is applied. A part of metal bus line 6*b* of scanning electrode 6 extends to the position corresponding to gap 13, and is formed on optical absorption film 8. In other words, priming discharge occurs between metal bus line 6*b* protruding toward area of gap 13 and priming electrode 14 formed on rear board 2.

In the PDP, front board 1 and rear board 2 face each other such that data electrode 9 and scanning electrode 6, and sustain electrode 7 intersect at right angles; and their peripheries are hermetically sealed. In cell space 11 formed by barrier rib 10, discharge spaces 17R, 17G and 17B for red, green and blue are created, and phosphor layer 12 of each color is formed on the wall of each discharge space. Discharge gases such as neon (Ne)—Xenon (Xe) are injected under a pressure of 400—600 torr. Discharge gas is discharge by selectively applying the video signal voltage to the scanning electrodes 6 and sustain electrodes 7. As a result, the ultraviolet rays emitted excite phosphor layer 12 of each color, and a color image is displayed when the phosphor emits red, green and blue colors. Moreover, in the PDP in this exemplary embodiment, priming discharge takes place in gap 13 so as to reduce discharge delay in writing. This realizes a PDP achieving a stable address characteristic, such as in a high-definition panel.

Figure 3:
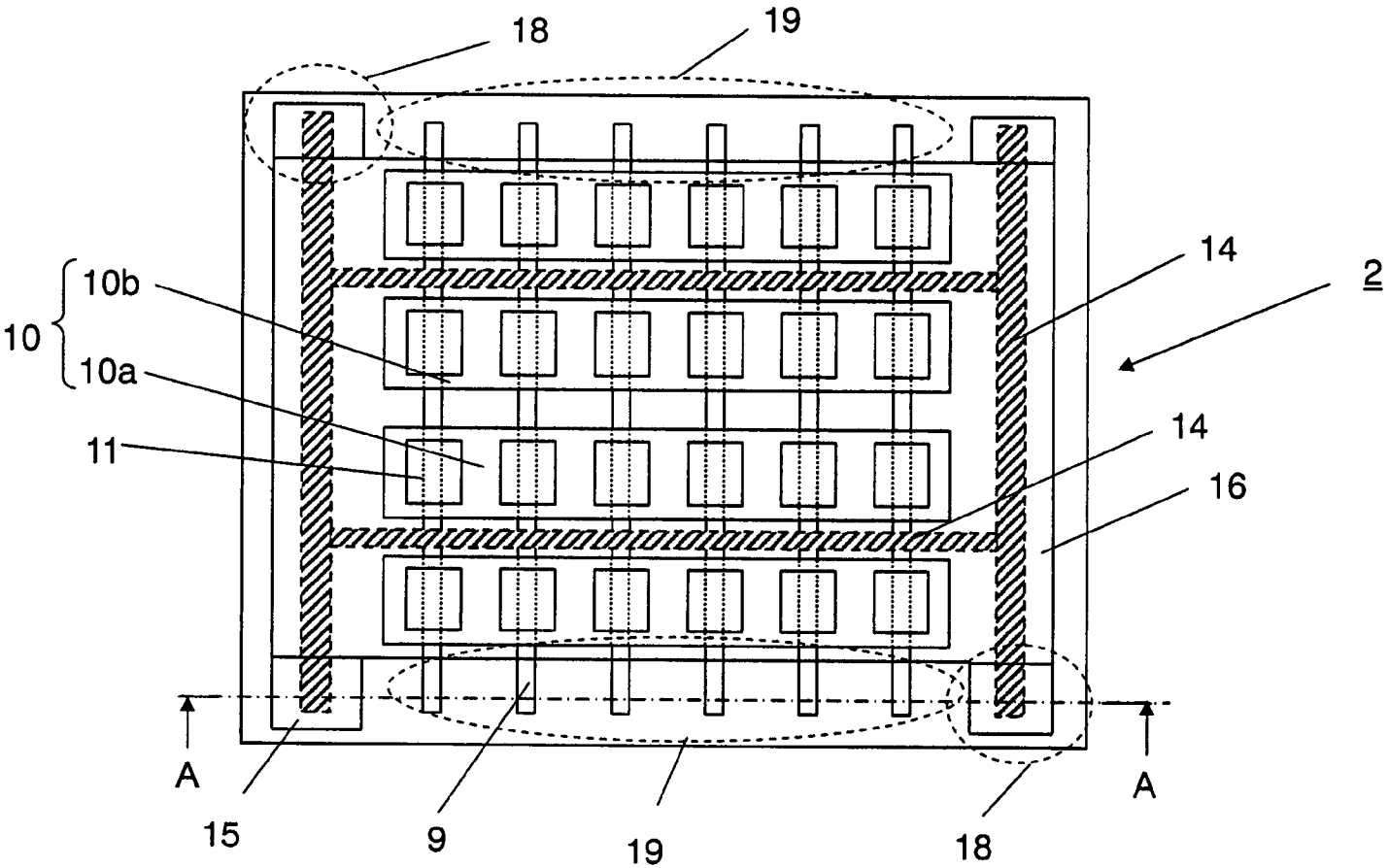
FIG. 3 is a plan view of the rear board of the PDP in accordance with the first exemplary embodiment of the present invention.
Figure 4:
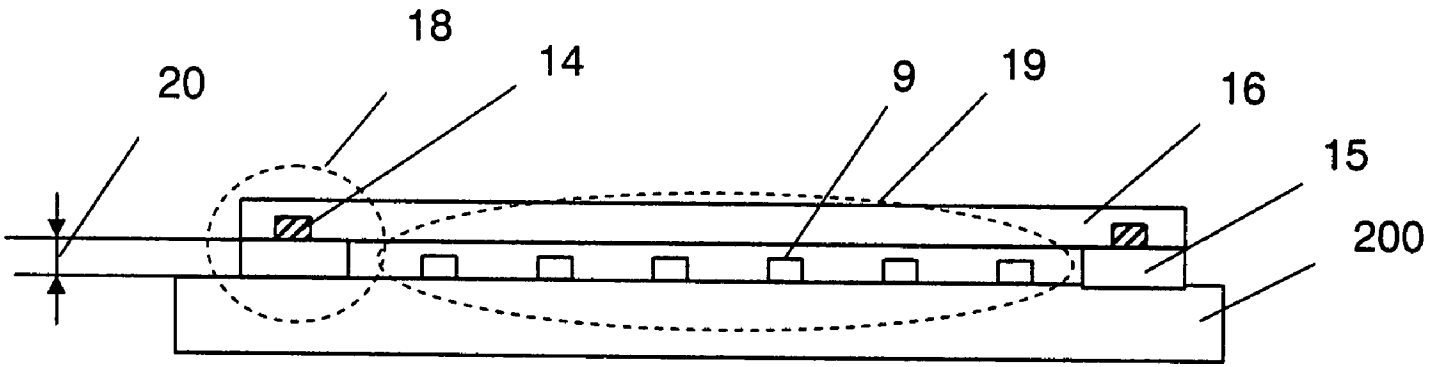
FIG. 4 is a sectional view taken along A—A in FIG. 3.

FIG. 3 shows a plan view of rear board 2 of the PDP in the first exemplary embodiment of the present invention, and FIG. 4 shows a sectional view taken along A—A in FIG. 3. Priming electrode 14, the third electrode, indicated by the broken line in FIG. 3, is formed only at gap 13, corresponding to adjacent scanning electrodes 6 to which a scanning pulse is applied, and the same potential is applied within the face of the PDP. This potential is different from that given to scanning electrodes 6 and sustain electrodes 7 configuring the first electrode and data electrodes 9 configuring the second electrode. Moreover, wiring lead-out 18 of priming electrode 14 is provided at the four corners of rear board 2, and dielectric layer 16 covers priming electrode 14 except for these wiring lead-outs 18. Dielectric layer 15 covers data electrodes 9 except for their wiring lead-outs 19. Accordingly, as shown in FIG. 4, wiring lead-outs 18 and wiring lead-outs 19 have step 20, equivalent to the film thickness of dielectric layer 15.

Figure 5:
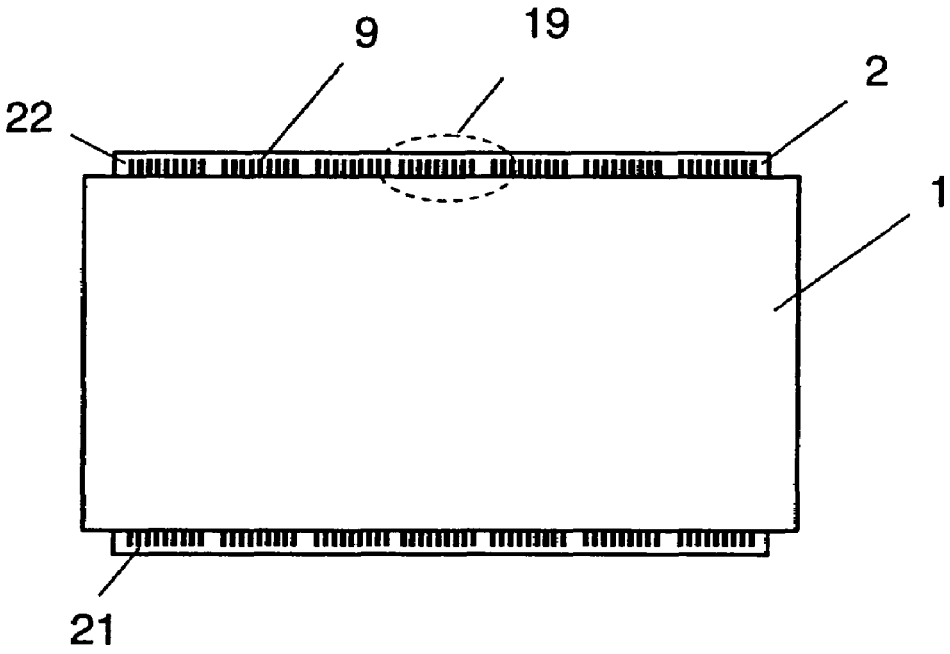
FIG. 5 is a plan view of a sealed PDP in accordance with the first exemplary embodiment of the present invention.

On the other hand, scanning electrodes 6, sustain electrodes 7, and data electrodes 9 of the PDP are connected to an electric circuit for driving and controlling electrodes using an FPC. FIG. 5 shows a plan view of a PDP in which front board 1 and rear board 2 are sealed, seen from the side of front board 1. Wiring lead-outs 19 of data electrodes 9 are provided at upper edge 22 and lower edge 21 of rear board 2 in several blocks.

Figure 6:
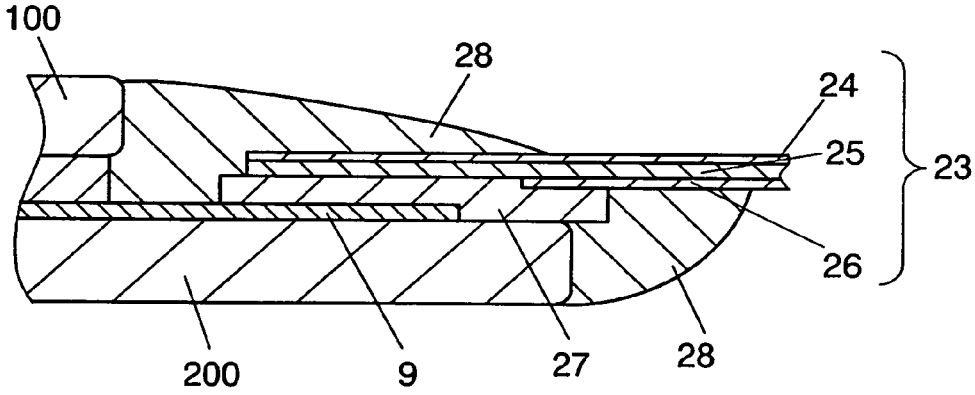
FIG. 6 is a sectional view of a structure in which an FPC is connected to a wiring lead-out of the PDP in accordance with the first exemplary embodiment of the present invention.

FIG. 6 shows a sectional view of a part where FPC 23 for connecting to external wiring is attached to wiring lead-out 19 of data electrode 9 when lead-out electrodes are in the same plane. FPC 23 has multiple wiring patterns 25, made such as of copper foil, formed on resin base film 24 that acts as a flexible insulator such as polyimide. A connecting portion at the end of wiring pattern 25 is exposed and the other portion of wiring pattern 25 is covered with resin cover film 26 such as polyimide. Wiring pattern 25 is connected to data electrode 9 of wiring lead-out 19 via anisotropic conductive material 27, and its periphery is covered with adhesive 28. Anisotropic conductive material 27 is made by dispersing conductive particles such as nickel (Ni) in an insulating material. Although anisotropic conductive material 27 shows no conductivity as it is, connection is established when conductive particles bond in the space between data electrode 9 and wiring patterns 25 as a result of sandwiching conductive particles between rear board 2 and FPC 23, and intensely compressing the insulating material by means of thermal pressing.

Figure 13B:
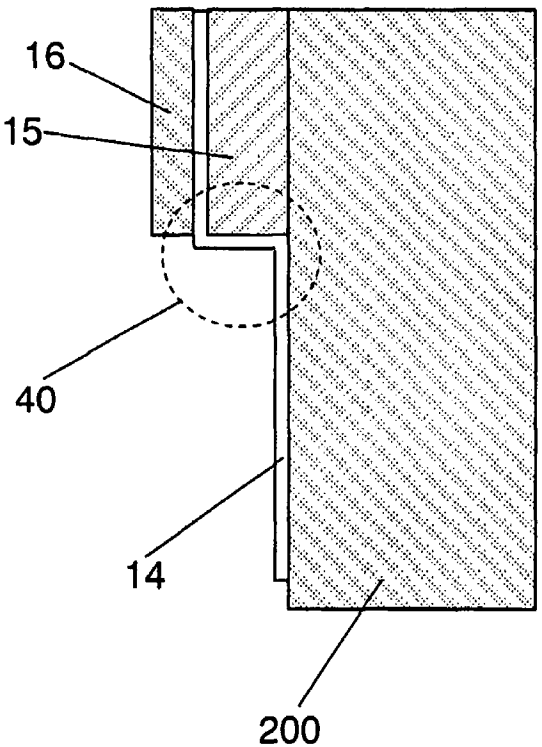
FIG. 13B is a sectional view taken along B—B in FIG. 13A.
Figure 13A:
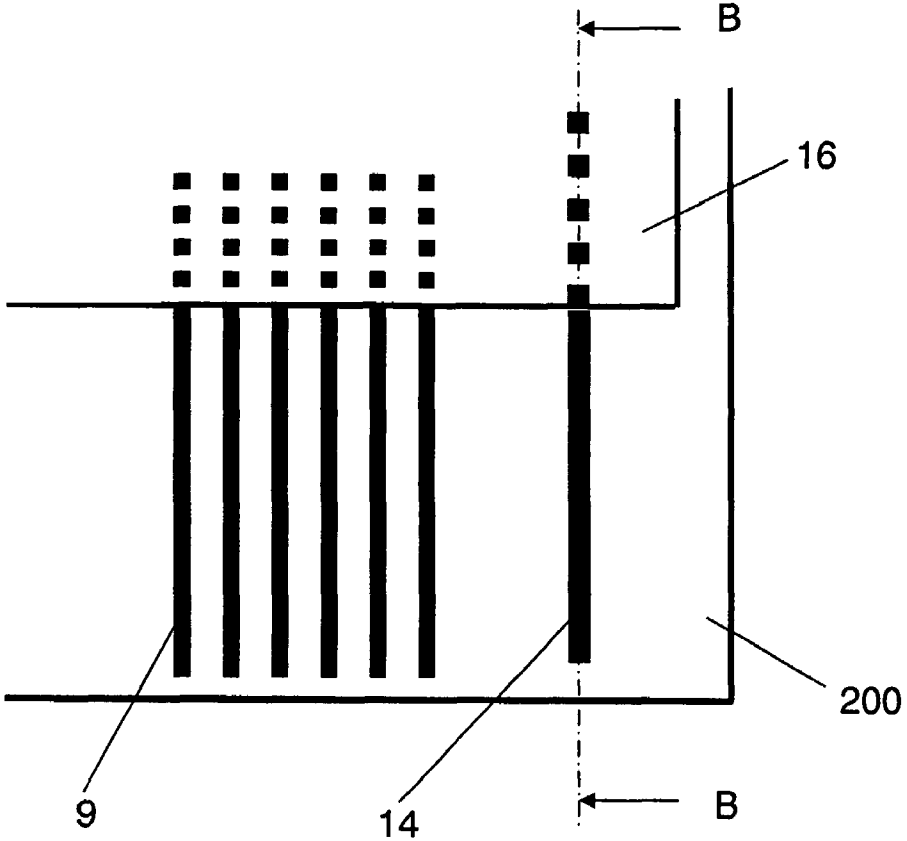
FIG. 13A is a plan view of a structure of the wiring lead-out when electrodes are disposed on a different level.

FIG. 13A is a plan view illustrating a wiring lead-out structure for leading out the electrode when a step exists between the electrodes in the PDP. FIG. 13B is a sectional view taken along B—B in FIG. 13A. One of the four corners shown in the plan view of rear board 2 in FIG. 3 is magnified. As shown in FIGS. 13A and 13B, data electrode 9 and priming electrode 14 are provided in the same plane at the wiring lead-outs so as to simplify a process including press-bonding of the FPC. More specifically, dielectric layer 15 is provided on rear substrate 200 and priming electrode 14 is disposed on dielectric layer 15, but wiring of priming electrode 14 and wiring of data electrode 9 are led out in the same plane of rear substrate 200 at the edge of rear substrate 200.

In this case, priming electrode 14 has step 40 equivalent to the thickness of dielectric layer 15. If the electrode wiring is stepped, the wiring thickness differs at the step, increasing wiring resistance at the thinned portion. This results in an inability to drive signals at high speed due to significant delay in carrying the signals. Accordingly, this step becomes a major obstacle to increasing pixel density to achieve higher-definition PDPs. In addition, such a step is likely to cause disconnection of electrodes, significantly reducing reliability.

Figure 7B:
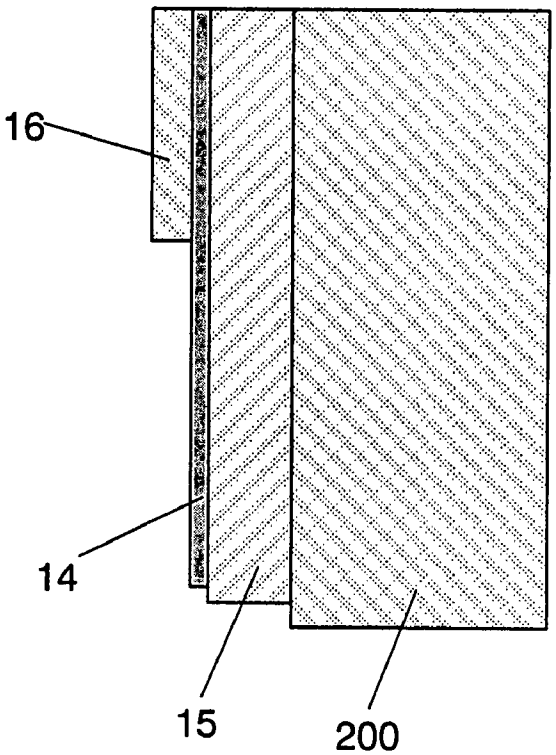
FIG. 7B is a sectional view taken along C—C in FIG. 7A.
Figure 7A:
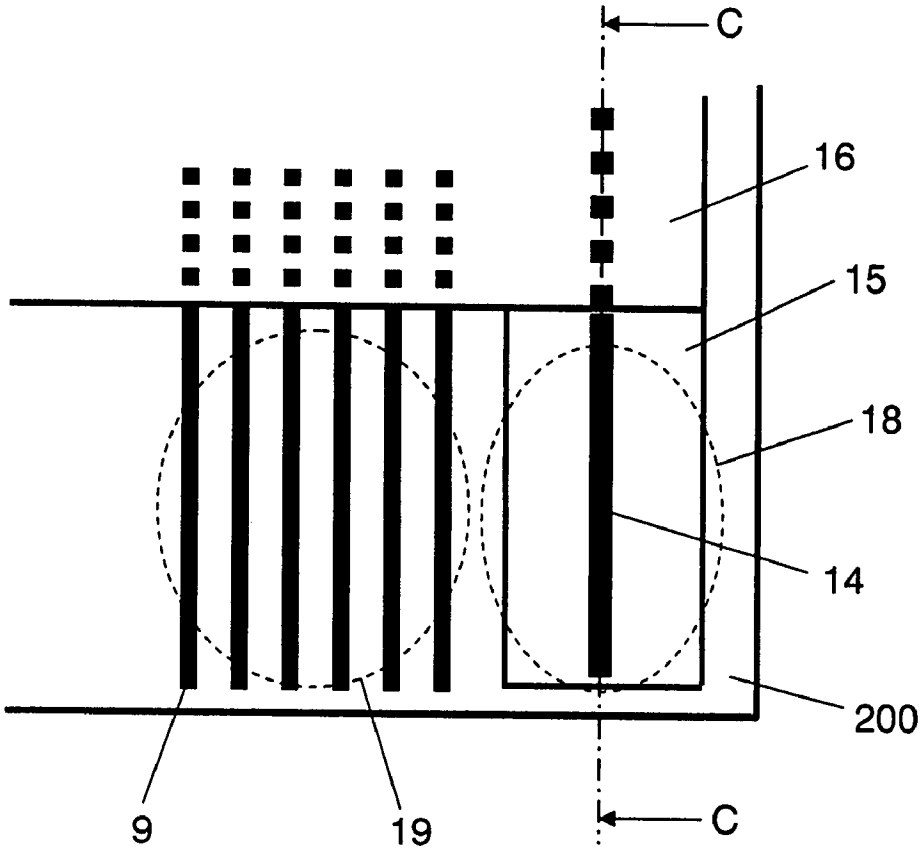
FIG. 7A is a plan view illustrating a structure of the wiring lead-out of the PDP in accordance with the first exemplary embodiment of the present invention.

FIGS. 7A and 7B show the detailed structure of the wiring lead-out of the PDP shown in FIGS. 3 and 4 in the first exemplary embodiment. FIG. 7A is a plan view, and FIG. 7B is a sectional view taken along C—C in FIG. 7A. In the first exemplary embodiment, wiring lead-out 18 of priming electrode 14 is formed on dielectric layer 15. In other words, the difference between the level of wiring lead-out 19 of data electrode 9 and the level of wiring lead-out 18 of priming electrode 14 is equivalent to the thickness of dielectric layer 15. Accordingly, data electrode 9 is connected to the FPC and priming electrode 14 is connected to the FPC at a different level, this difference being equivalent to the height of step 20, as shown in FIG. 4.

Priming electrode 14, the third electrode in the present invention, is an electrode that gives the same potential in the PDP face. This potential is different from that of other electrodes. This means that the function of priming electrode 14 is achievable with at least one wiring lead-out 18, although wiring lead-out 18 is provided at the four corners in FIG. 3. The FPC connection to wiring lead-out 19 of data electrode 9 can thus be established in a separate process. Accordingly, priming electrode 14 can be formed in the same plane, eliminating stepped electrode wiring and allowing signals to be driven at high speed. In addition, failures such as disconnection due to variable wiring thickness of electrodes and degradation by heat generated due to high wiring resistance can be reduced, making feasible a PDP with highly reliable wiring.

In the first exemplary embodiment, the wiring lead-out direction of priming electrode 14 and the wiring lead-out direction of data electrode 9 are the same, but are not necessarily leading in the same direction, depending on the pattern of dielectric layer 15.

SECOND EXEMPLARY EMBODIMENT

Figure 8B:
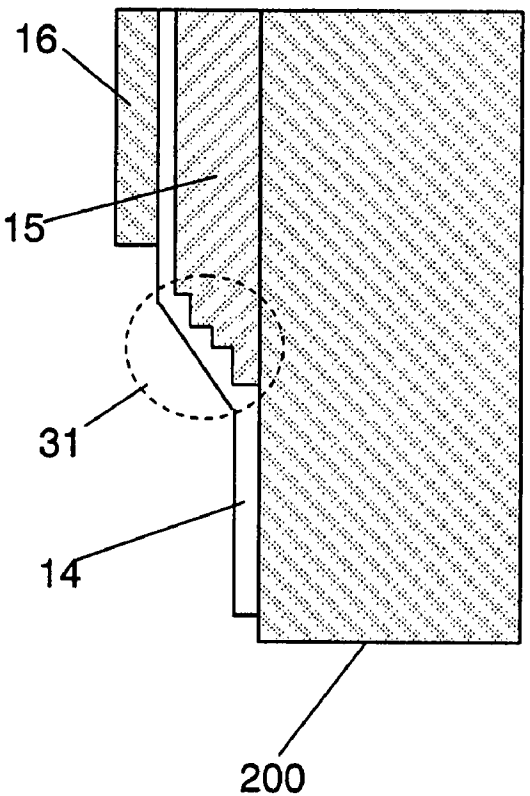
FIG. 8B is a sectional view taken along D—D in FIG. 8A.
Figure 8A:
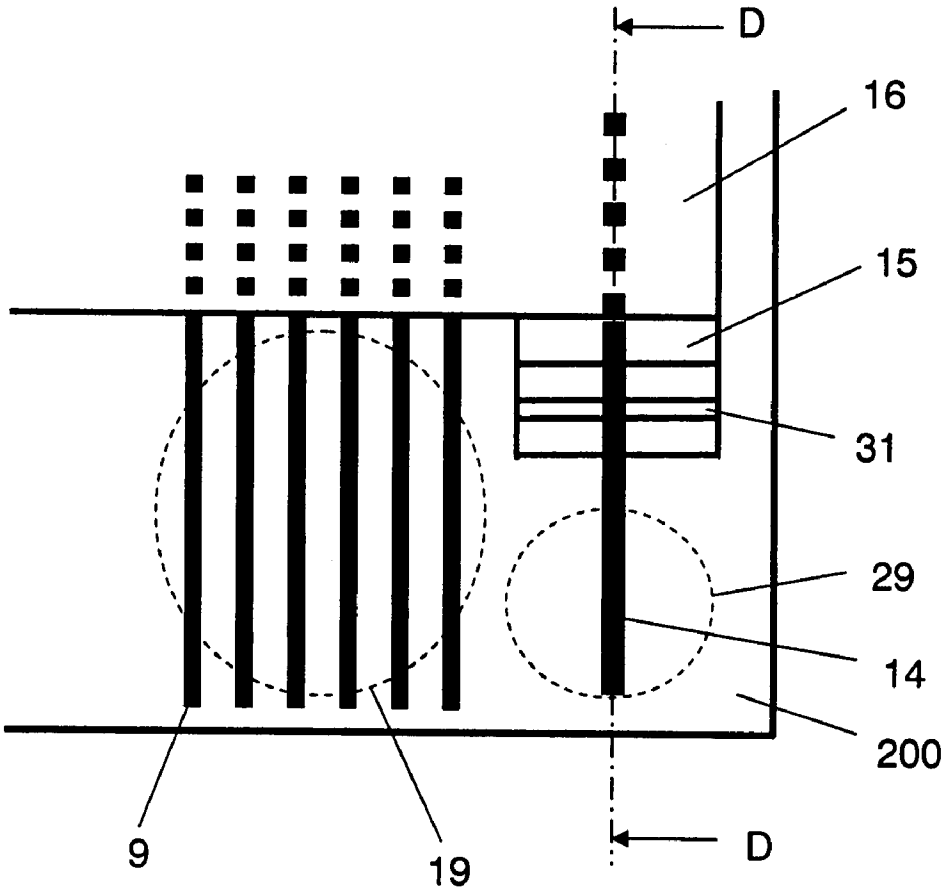
FIG. 8A is a plan view illustrating a structure of a wiring lead-out of a PDP in accordance with the second exemplary embodiment of the present invention.

FIGS. 8A and 8B show details of a structure of a wiring lead-out of a PDP in the second exemplary embodiment of the present invention. FIG. 8A is a plan view, and FIG. 8B is a sectional view taken along D—D in FIG. 8A.

In the second exemplary embodiment, slope 31 is provided in the wiring lead-out area of priming electrode 14. In this slope 31, the film thickness of dielectric layer 15 gradually reduces in a slope toward the edge of rear substrate 200, and wiring lead-out 29 is formed on rear substrate 200. Accordingly, priming electrode 14 and data electrode 9 are in the same plane at wiring lead-out 29 connected to the FPC.

As described above, the thickness of dielectric layer 15 is gradually reduced in the wiring lead-out area of priming electrode 14 such that there is no effect of reduced thickness or line width of priming electrode 14 that is formed on dielectric layer 15. This secured the reliability of wiring of priming electrode 14. Moreover, connection to the FPC is established in the same plane as wiring lead-out 19 of data electrode 9. This allows connection of priming electrode 14 to the FPC and connection of data electrode 9 to the FPC in the same process, simplifying the manufacturing process. Furthermore, provision of priming electrode 14 and data electrode 9 in the same plane allows sharing of the wiring FPC between priming electrode 14 and data electrode 9.

The thickness of dielectric layer 15 can be reduced step by step or linearly as long as the thickness is changed in a way such that to eliminate any non-uniformity in electrode thickness and line width when forming priming electrode 14 on dielectric layer 15.

THIRD EXEMPLARY EMBODIMENT

Figure 9B:
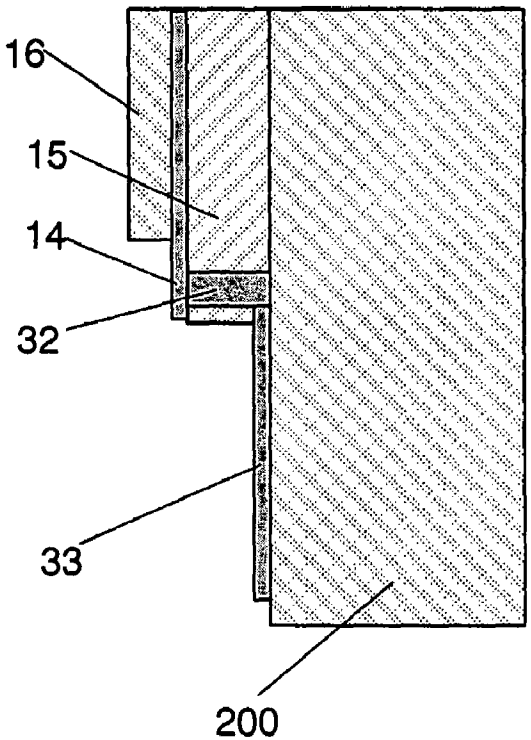
FIG. 9B is a sectional view taken along E—E in FIG. 9A.
Figure 9A:
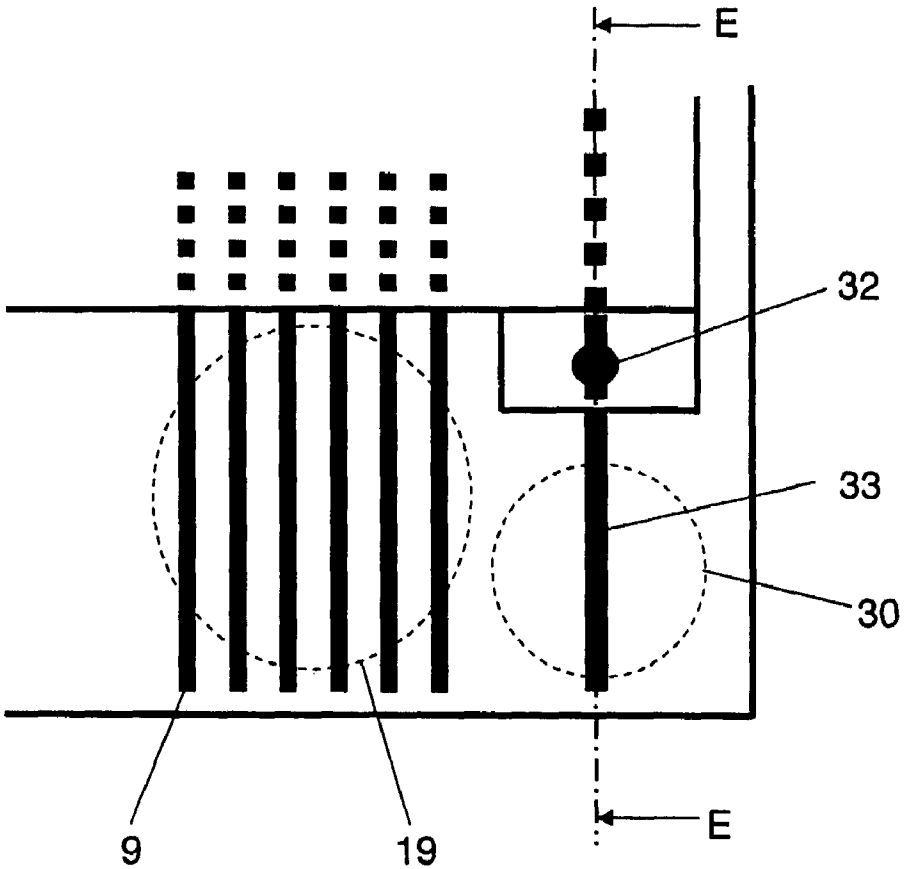
FIG. 9A is a plan view of a structure illustrating a wiring lead-out of a PDP in accordance with the third exemplary embodiment.

FIGS. 9A and 9B show the details of a structure of wiring lead-out of a PDP in the third exemplary embodiment. FIG. 9A is a plan view, and FIG. 9B is a sectional view taken along E—E in FIG. 9A.

In the third exemplary embodiment, priming electrode wiring 33 formed on rear substrate 200 in advance and priming electrode 14 formed on dielectric layer 15 are connected by via hole 32 created on dielectric layer 15. This via hole is filled with conductive material. Accordingly, wiring lead-out 30 to be connected to the FPC is formed in the same plane as data electrode 9.

Via hole 32 is created such as by laser beam after forming dielectric layer 15, and the conductive material is injected into via hole 32. This method secures the wiring reliability of priming electrode 14. In addition, connection to the FPC is established in the same plane as wiring lead-out 19 of data electrode 9. This allows wiring to be carried out in the same process as connection of the FPC to data electrode 9, simplifying the manufacturing process.

FOURTH EXEMPLARY EMBODIMENT

Figure 10B:
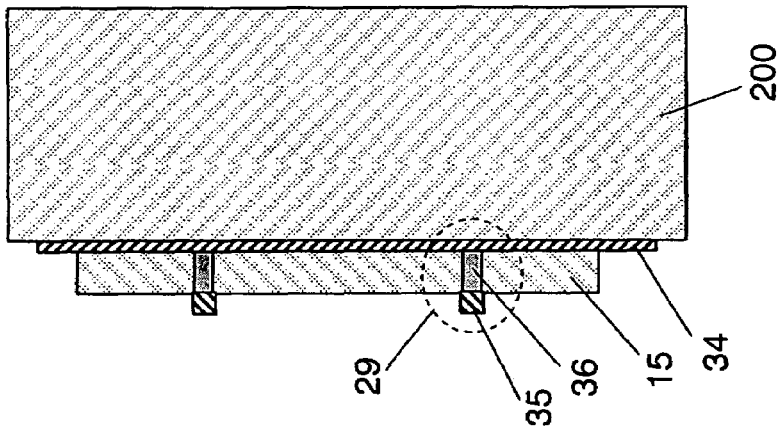
FIG. 10B is a sectional view taken along F—F in FIG. 10A.
Figure 10A:
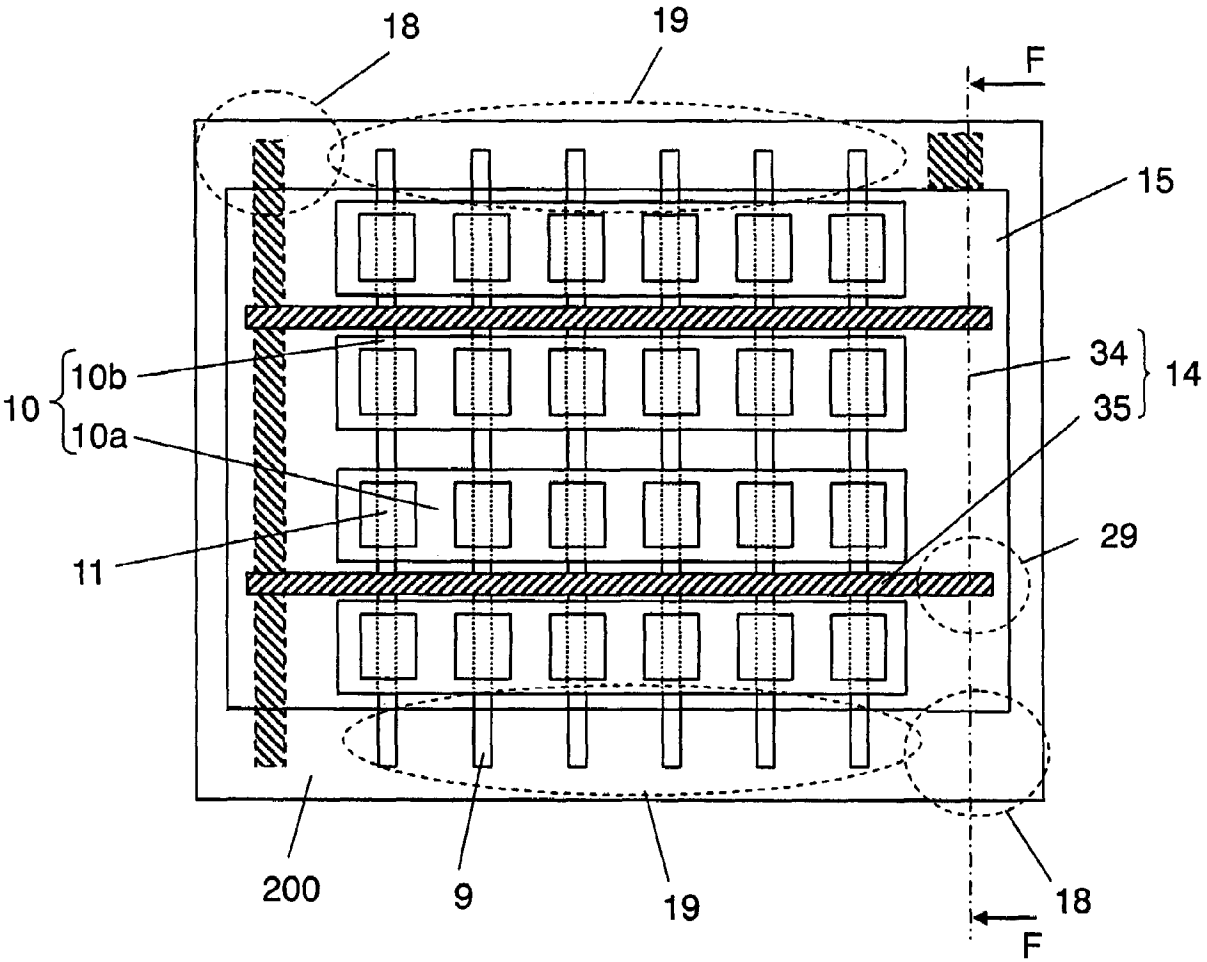
FIG. 10A is a plan view illustrating a structure of a wiring lead-out of a PDP in the fourth exemplary embodiment of the present invention.

FIGS. 10A and 10B show details of the structure of a wiring lead-out in the fourth exemplary embodiment of the present invention. FIG. 10A is a plan view illustrating the structure of a rear board, and FIG. 10B is a sectional view taken along F—F in FIG. 10A.

As shown in FIGS. 10A and 10B, priming electrode 14 includes vertical priming electrode 34 and horizontal priming electrode 35. Vertical priming electrode 34 also acts as wiring lead-out of priming electrode 14. Vertical priming electrode 34 is formed on rear substrate 200, same as data electrode 9, and horizontal priming electrode 35 is formed on dielectric layer 15. A dielectric layer can be further formed on horizontal priming electrode 35. Via hole 36 is create on dielectric layer 15 at the crossing of vertical priming electrode 34 and horizontal priming electrode 35. Conductive material is injected into via hole 36 to secure mutual conductivity.

The above structure enables formation of vertical priming electrode 34 at the same time as forming data electrode 9 on rear substrate 200. In addition, wiring lead-out 18 of priming electrode 14 can be connected to the FPC in the same plane as wiring lead-out 19 of data electrode 9. Accordingly, this connection can be established in the same process as connection of data electrode 9 to the FPC, thus simplifying the process.

FIFTH EXEMPLARY EMBODIMENT

Figure 11:
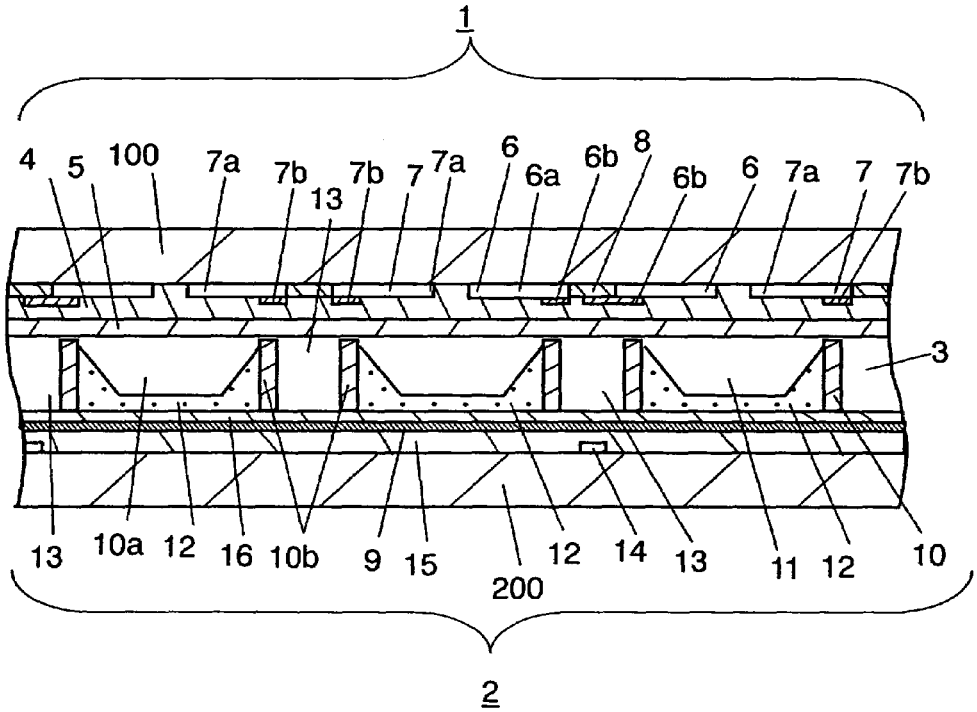
FIG. 11 is a sectional view of a PDP in the fifth exemplary embodiment of the present invention.

FIG. 11 is a sectional view of a PDP in the fifth exemplary embodiment of the present invention. As shown in FIG. 11, the structures of data electrode 9, i.e., the second electrode, and priming electrode 14, i.e., the third electrode, formed on rear substrate 200 differ from those in the first exemplary embodiment.

More specifically, in the fifth exemplary embodiment, priming electrode 14 is first formed on rear substrate 200. Dielectric layer 15 is then provided covering priming electrode 14. Data electrode 9 is then disposed on dielectric layer 15. Moreover, dielectric layer 16 that also acts as a base for forming barrier ribs is provided covering data electrode 9. Barrier rib 10 is formed on this dielectric layer 16. As described above, the fifth exemplary embodiment has a different structure for rear substrate 200, but the same structure as the first exemplary embodiment for front substrate 100.

Accordingly, the fifth exemplary embodiment has data electrode 9 formed closer to discharge space 3 than priming electrode 14. This allows a thinner dielectric layer 16 to be formed on data electrode 9, enabling lower voltage during write discharge. Write discharge can thus be stabilized. Dielectric layer 15, formed on priming electrode 14, is a dielectric layer between priming electrode 14 and data electrode 9, and any material at any thickness can be applied to secure insulation between priming electrode 14 and data electrode 9.

The structure described in the first to fourth exemplary embodiments is applicable to the structure of wiring lead-out 18 of priming electrode 14 and wiring lead-out 19 of data electrode 9 in the fifth exemplary embodiment. However, the positions of priming electrode 14 and data electrode 9 in the fifth embodiment are upside down with respect to dielectric layer 15.

Figure 12B:
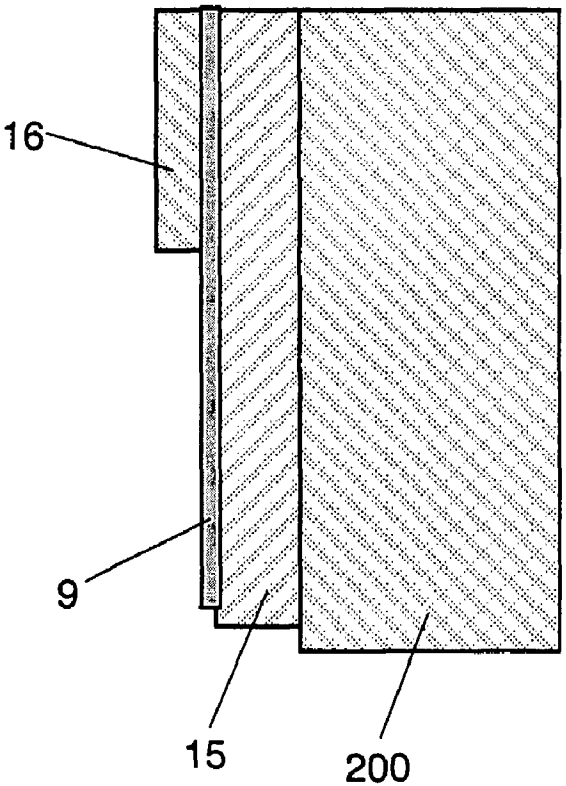
FIG. 12B is a sectional view taken along C—C in FIG. 12A.
Figure 12A:
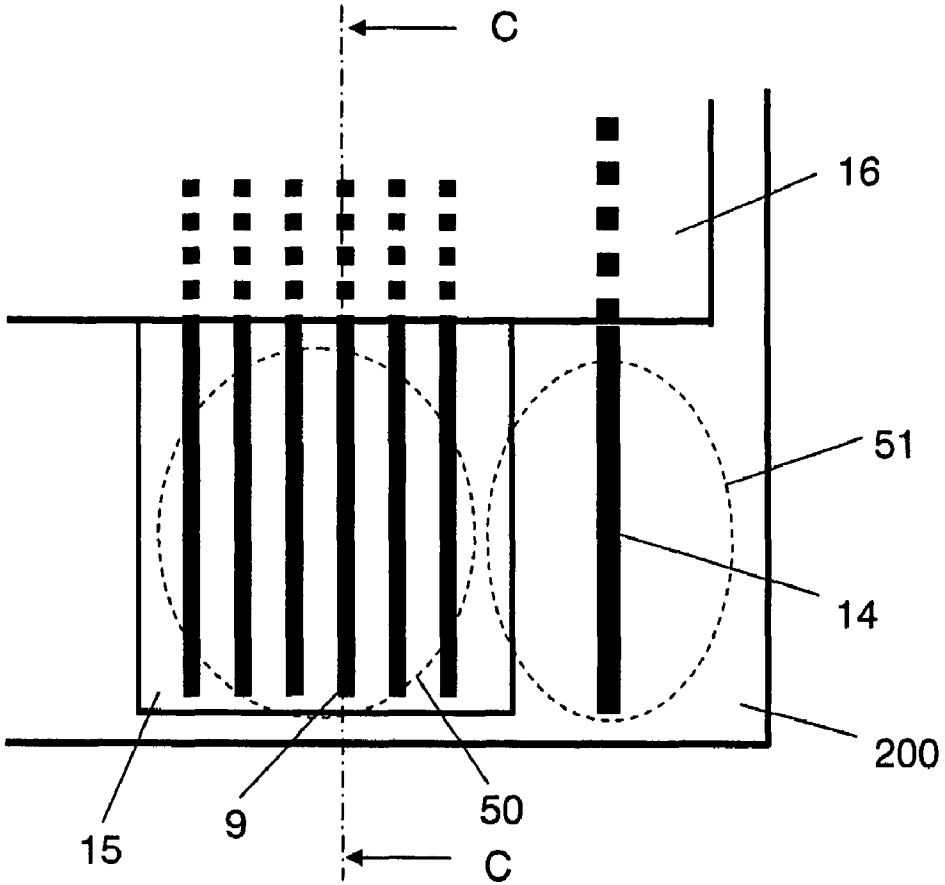
FIG. 12A is a plan view of a structure of a wiring lead-out member of the PDP in accordance with the fifth exemplary embodiment of the present invention.

As an example, the structure of the wiring lead-out identical to that described in the first exemplary embodiment is shown in FIGS. 12A and 12B. In the structure of the first exemplary embodiment shown in FIGS. 7A and 7B, wiring lead-out 18 of priming electrode 14 is provided on dielectric layer 15. However, in the fifth exemplary embodiment, wiring lead-out 50 of data electrode 9 is provided on dielectric layer 15, and wiring lead-out 51 of priming electrode 14 is provided on rear substrate 200. Accordingly, a PDP with highly reliable wiring can be realized by securing stable wiring even though the positions of data electrode 9 and priming electrode 14 are reversed.

In the above exemplary embodiments, dielectric layer 15 or dielectric layer 16 has a patterned shape at the wiring lead-out. This pattern can be formed using known methods including screen-printing and photo etching.

Furthermore, the above exemplary embodiments refer to the case of the two-layer electrode on the rear board. It is apparent, however, the structure of the present invention is not limited to the rear board. Naturally, the wiring lead-out structure of the present invention is also applicable to a multi-layer structure of two or more layers for the front board or for both front and rear boards.

INDUSTRIAL APPLICABILITY

The present invention employs a structure without a step in the electrode wiring at the wiring lead-out of the PDP. This eliminates variations in the wiring thickness of the electrode, and problems deriving from the resultant high wiring resistance. Accordingly, a highly reliable PDP suitable for a large-screen display device is achieved.

What is claimed is:

1. A plasma display panel comprising:

a front board having a display electrode, said display electrode being composed of a scanning electrode and a sustain electrode;

a rear board having a data electrode and a priming electrode, said rear board being arranged such that a discharge space is formed between said front board and said rear board;

a first dielectric layer disposed so as to cover at least a portion of said data electrode; and a second dielectric layer disposed so as to cover at least a portion of said priming electrode;

wherein said priming electrode is formed on said first dielectric layer, wherein wiring lead-out portions of said priming electrode are disposed at corners of said rear board, wherein said second dielectric layer does not cover said wiring lead-out portions of said priming electrode, and wherein peripheries of said front board and said rear board are sealed.

2. The plasma display panel as defined in claim 1, wherein said wiring lead-out portions of said priming electrode are located on a different plane than wiring lead-out portions of said data electrode.

3. The plasma display panel as defined in claim 1, wherein said wiring lead-out portions of said priming electrode are located on a same plane as wiring lead-out portions of said data electrode.

4. A plasma display panel comprising:

a front board having a display electrode, said display electrode being composed of a scanning electrode and a sustain electrode;

a rear board having a data electrode and a priming electrode, said rear board being arranged such that a discharge space is formed between said front board and said rear board; and a dielectric layer disposed so as to cover at least a portion of said data electrode;

wherein said priming electrode is formed on said dielectric layer which covers at least a portion of said data electrode, wherein wiring lead-out portions of said priming electrode are disposed at corners of said rear board, wherein said dielectric layer is provided with an inclined portion such that a thickness of said dielectric layer is reduced toward an end portion of said rear board in an inclined manner, and wherein peripheries of said front board and said rear board sealed.

5. The plasma display panel as defined in claim 4, wherein said wiring lead-out portions of said priming electrode are located on a same plane as wiring lead-out portions of said data electrode.

6. A plasma display panel comprising:

a front board having a display electrode, said display electrode being composed of a scanning electrode and a sustain electrode;

a rear board having a data electrode, a priming electrode and a priming electrode wiring, said rear board being arranged such that a discharge space is formed between said front board and said rear board;

a dielectric layer disposed so as to cover at least a portion of said data electrode; and a via hole formed in said dielectric layer, wherein said priming electrode is formed on said dielectric layer which covers at least a portion of said data electrode, wherein wiring lead out portions of said priming electrode are disposed at corners of said rear board, wherein said priming electrode and said priming electrode wiring are coupled to one another through said via-hole formed in said dielectric layer, and wherein peripheries of said front board and said rear board are sealed.

7. The plasma display panel as defined in claim 6, wherein said wiring lead-out portions of said priming electrode are located on a same plane as wiring lead-out portions of said data electrode.

* * * * *